US010843053B2

(12) United States Patent
Carter

(10) Patent No.: US 10,843,053 B2
(45) Date of Patent: Nov. 24, 2020

(54) GOLF CLUB WITH CARTRIDGE

(71) Applicant: Vandette B. Carter, Yorktown Heights, NY (US)

(72) Inventor: Vandette B. Carter, Yorktown Heights, NY (US)

( * ) Notice: Subject to any disclaimer, the term of this patent is extended or adjusted under 35 U.S.C. 154(b) by 0 days.

(21) Appl. No.: 16/147,570

(22) Filed: Sep. 28, 2018

(65) Prior Publication Data

US 2019/0105544 A1 Apr. 11, 2019

Related U.S. Application Data

(60) Provisional application No. 62/565,077, filed on Sep. 28, 2017.

(51) Int. Cl.

| | |
|---|---|
| ***A63B 53/06*** | (2015.01) |
| ***A63B 53/08*** | (2015.01) |
| ***A63B 53/04*** | (2015.01) |
| ***A63B 1/00*** | (2006.01) |
| *A63B 102/32* | (2015.01) |

(52) U.S. Cl.

CPC ..... *A63B 53/08* (2013.01); *A63B 1/00* (2013.01); *A63B 53/047* (2013.01); *A63B 53/0466* (2013.01); *A63B 53/06* (2013.01); *A63B 2053/0412* (2013.01); *A63B 2053/0437* (2013.01); *A63B 2053/0479* (2013.01); *A63B 2053/0491* (2013.01); *A63B 2102/32* (2015.10)

(58) Field of Classification Search

USPC ..... 473/324–350

See application file for complete search history.

(56) References Cited

U.S. PATENT DOCUMENTS

| | | | | | |
|---|---|---|---|---|---|
| 1,213,382 | A | * | 1/1917 | Kent | A63B 53/04 473/338 |
| 2,517,245 | A | * | 8/1950 | Scott | A63B 53/04 473/339 |
| 4,085,934 | A | * | 4/1978 | Churchward | A63B 53/04 473/338 |
| 4,898,389 | A | * | 2/1990 | Plutt | A63B 69/3617 473/223 |

(Continued)

FOREIGN PATENT DOCUMENTS

| | | | | |
|---|---|---|---|---|
| JP | 01043278 | A | * 2/1989 | |
| JP | 11319167 | A | * 11/1999 | |
| JP | 2002011124 | A | * 1/2002 | A63B 53/04 |

*Primary Examiner* — Alvin A Hunter

(74) *Attorney, Agent, or Firm* — Ohlandt, Greeley, Ruggiero & Perle, L.L.P.

(57) ABSTRACT

A golf club comprising a head having a series of tracks within a cartridge that's removable from the inside of the club head, which forms a three-dimensional pattern; a plurality of weights for positioning along the channels of the cartridge, and a mechanism for securing the weights at arbitrary positions along the channels within the cartridge, so as to customize at least one of center of gravity and moment of inertia from the crown or sole of the club head. The channels can all interconnect with one another to allow a weight to be moved from one to another. The golf club can further have an articulating cover for at least a portion of the surface, the cover being for covering and concealing the cartridge situated within the club head and the weights therein, positioned along the channels thereof.

16 Claims, 7 Drawing Sheets

(56) References Cited

U.S. PATENT DOCUMENTS

| | | | | | |
|---|---|---|---|---|---|
| 5,288,080 | A * | 2/1994 | Tice | A63B 69/3614 | 473/220 |
| 5,683,309 | A * | 11/1997 | Reimers | A63B 53/04 | 473/337 |
| 5,692,964 | A * | 12/1997 | Smith | A63B 69/3614 | 273/DIG. 30 |
| 5,868,633 | A * | 2/1999 | Keheley | A63B 69/3635 | 273/DIG. 14 |
| 6,089,994 | A * | 7/2000 | Sun | A63B 53/04 | 473/338 |
| 6,409,612 | B1 * | 6/2002 | Evans | A63B 53/04 | 473/324 |
| 6,458,044 | B1 * | 10/2002 | Vincent | A63B 53/04 | 473/334 |
| 6,592,468 | B2 * | 7/2003 | Vincent | A63B 53/047 | 473/334 |
| 6,902,495 | B2 * | 6/2005 | Pergande | A63B 53/047 | 473/332 |
| 7,166,041 | B2 * | 1/2007 | Evans | A63B 53/0466 | 473/334 |
| 7,309,297 | B1 * | 12/2007 | Solari | A63B 53/04 | 473/334 |
| 8,579,724 | B2 * | 11/2013 | Evans | A63B 53/0466 | 473/334 |
| 8,721,472 | B2 * | 5/2014 | Kuan | A63B 53/0487 | 473/341 |
| 8,956,238 | B2 * | 2/2015 | Boyd | A63B 53/00 | 473/223 |
| 8,968,116 | B1 * | 3/2015 | Myers | A63B 53/0466 | 473/338 |
| 9,211,453 | B1 * | 12/2015 | Foster | A63B 53/06 | |
| 9,504,889 | B2 * | 11/2016 | Mitzel | A63B 60/00 | |
| 9,597,567 | B1 * | 3/2017 | Tran | A63B 60/46 | |
| 9,849,361 | B2 * | 12/2017 | Coza | A63B 69/002 | |

* cited by examiner

GOLF CLUB WITH CARTRIDGE

CROSS-REFERENCE TO RELATED APPLICATIONS

This application incorporates by reference the following applications: Ser. No. 11/833,970 filed on Aug. 3, 2007, which claims priority under 35 U.S.C. § 119(e) from U.S. Provisional Patent Application Ser. No. 60/835,048 filed on Aug. 3, 2006 and published patent application number 2008/0261715, now U.S. Pat. No. 9,700,764.

BACKGROUND OF THE INVENTION

Field of the Invention

The present invention relates to golf clubs. More particularly, it relates to a scalable approach for adjusting the (COG)-weight distribution within a golf club's head, particularly of a driver, fairway woods, wedge, hybrid, iron or putter, from the club's head or its handle.

Background Art

The USGA governing body has allowed for the adjustments of weights within a golf club's head as part of fulfilling the criteria of approved conforming golf clubs. Many manufacturers have resorted to a conventional approach to capitalize on the advantage of adjusting the center of gravity (COG) within a club's design, by simply interchanging 'nuts and bolts' on the golf club's head, or affixing weights in areas of advantage in the club head in a permanent manner.

Others have implemented a single 2D track or multiple (non-connecting) 2D tracks, weight (trough) system. These implementations lack the ability to combined weights from one track to another, while keeping the weight of the club head constant, as taught in U.S. Pat. No. 9,700,764, to Carter.

The drawback with the prior art is that each time a user desire to adjust the COG within the golf club's head, the player must either remove weighted elements from the club or add a different weight; or be relegated to a single 2D trough system, which is often open to the elements. Said open trough system, lacks a protective cover over the sole of the club, as taught by U.S. Pat. No. 9,700,764.

This restrictive adjustability of the club head requires the replacement or substitution of the removed weighted element in order to manipulate the COG. There is no ability to keep the weight of the club head constant or to move weight from one track (or trough) to another track without changing the mass.

The COG variations of the prior art are therefore limited and severely restrictive, and are overwhelming dependent on a finite number of nuts and bolts available for a particular club head, to allow the weights to be adjusted in a restrictive manner, within a dual but non-connected 2D trough channel, as seen, for example, in U.S. Pat. No. D774,152 to Todd P. Beach et al.

The removal of "nuts and bolts" are obviously time consuming; they require a placement chart & multiple trials and errors before the desirable COG result can be achieved. When an undesirable playing effect is appreciated, the player must tackle the golf club numerous times by interchanging a multiplicity of 'nuts and bolts, carefully recalling 'what goes where' etc.

In the case of sliding weights, in a single 2D opened trough, as seen in the example of prior art U.S. Pat. No. D774,152 and U.S. Pat. No. 8,696,491, the directions of weight movement are restricted to either forward or backward, in one plane and not in a 3D manner as taught in U.S. Pat. No. 9,700,764 (Carter).

The open "burrows" (troughs) confined to the sole of the club head utilize a two dimensional (2D) approach to adjust the COG.

Moreover, a single port of entry and exit, to add and subtract weights to the club head can be seen in, for example, United States Patent Publication 2006/0122004 of Chen et al. Further the "burrows" (troughs) are gapingly opened to the elements, thereby potentially affecting the club's functionality (COG) during play, when debris become trapped therein, when a cover is not preventing foreign body from entering the cavity. These limitations are drawbacks for a moveable weight golf club technology, which can be approved upon at the basic level, to be more aerodynamic and "plain in design" as per USGA rule 4, appendix II (33$^{rd}$ edition).

U.S. Pat. No. 6,015,354 to Ahn et al. teaches a method to interchange the weight of a golf club's head to affect the COG. In Ahn et al., the removal and replacements of weights are stressed and the weights may only be allowed to move across a two-dimensional plain, as in most of the prior patented examples.

United States Patent Publication No.: 2004/0242343, to Chao et al., describes a method of interchanging and substituting weights within a golf club's head. The mass of the club head is generally changed when this is done, and not kept constant as seen in Carter.

As before, Chao's invention is limited in its 2D design and function. Weights can only be fixed into a predetermined location and the removal thereof is required for adjustments of the COG. The position of the COG is severely restricted as in the cited arts. Furthermore, a multiplicity of weights cannot be removed or substituted at the same time, along any given part of the track or trough, as taught once again in U.S. Pat. No. 9,700,764 (Carter).

In United States Patent Publication No. 2006/0122004, Chen et al. describes a method for placing weights in a "trough" located in the "back" of a club head, having a "larger width" and "insertion hole." This approach limits the true dynamics of achieving a versatile or variable center of gravity (COG), aesthetics; or the ability to position the club's weighted elements in locations of appreciable benefits; such as on the complex 3D contour surface of the sole of the club; without having to thicken the club structure); or needing to be placed along the outer perimeter of the club's head, which when done violates USG rule 4, appendix II.

As noted before, there is a single limited access (port of entry) for weight addition and subtraction in Chen. Chen's invention lacks multiple points of entry for weights to be added to the club head or substituted as a set, instead of individually, as is seen in all of the mentioned prior art. None of the prior art has provided a means to remove and replace a set of weights as a set or change multiple weights simultaneously.

Further still, in U.S. Pat. No. 9,682,298, which features merging multiple troughs; the aforementioned is relegated to a single weight, in one track, in the opened trough design, and lacks the ability to combine multiple weights, garnered from different tracks as taught in Carter.

Further still, the weights are deeply recessed in the trough, in U.S. Pat. No. 9,682,298; they are opened to the elements; they lack the basic ability to adjust the COG, close to the sole of the club's head. Most of all, a protective cover is not provided over the sole as in U.S. Pat. No. 9,700,764 (Carter).

In all the prior art the weights are confined within the club head in an open track (trough) configuration as described in the prior art which are accessible or adjusted from the outside (sole) only.

In the referenced patent, issued to Carter, a method is shown to manipulate the COG of the club by adjusting one or more weights onto one or more tracks in a 3D manner, interchanging said weights onto any number of tracks from outside of the club head.

The aforementioned technology by Carter described multiple approaches to secure moveable weights onto multiple tracks within the club's head; modify the COG of the club, which is achieved by affixing the weights either below the cover, within the cover, or within the cavity of the club head. These innovative embodiments are all incorporated by reference, for all purposes, herein.

It is an object of the present invention to incorporate the benefits of U.S. Pat. No. 9,700,764, while advancing the technology as follow:

SUMMARY OF THE DISCLOSURE

Though the innovation by Carter has proven to be novel and advanced over the prior 2D art; the ability to totally conceal the weights in the club head, with no external adjustable screws or knobs, offers greater advantage esthetically, aerodynamically and functionally, as will be demonstrated below.

This disclosure is directed to a golf club head having a crown, sole and a face, is engineered with a 3D adjustable center of gravity, moment of inertia, from within the cavity of the golf club head, via a hinged accessible port, associated with the crown or the sole of the club head.

It is an object of the invention to permit the substitution of a given set of weights as a group or individually, into or onto a removable cartridge, designed to fit within the cavity of the club head.

A further object is to have a given number of weights permanently fixed to the inside of the club's head cavity, upon the port access, which maybe the crown or the sole, thereby negating the need to substitute weights from the outside. The access port may comprise a portion or the entire segment of the crown or sole of the club and be articulated within a 0 to 180 degree range, from a closed, to an opened position and vice versa.

The club's center of gravity is adjustable by relocating the number of given weights along a given three dimensional (3D) path/track or tracks, affecting its center of gravity and moment of inertia, from within the club head, once the access port is in the opened position, from the crown or the sole.

The golf clubs disclosed herein overcome inconveniences seen in a plethora of prior arts by improving the club aerodynamic appearance, achieved by enclosing the weights inside of the club head; while providing a convenient access by way of an articulating port (door), thereby conforming to the USGA rule, 4, paragraph c: "plain in design."

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
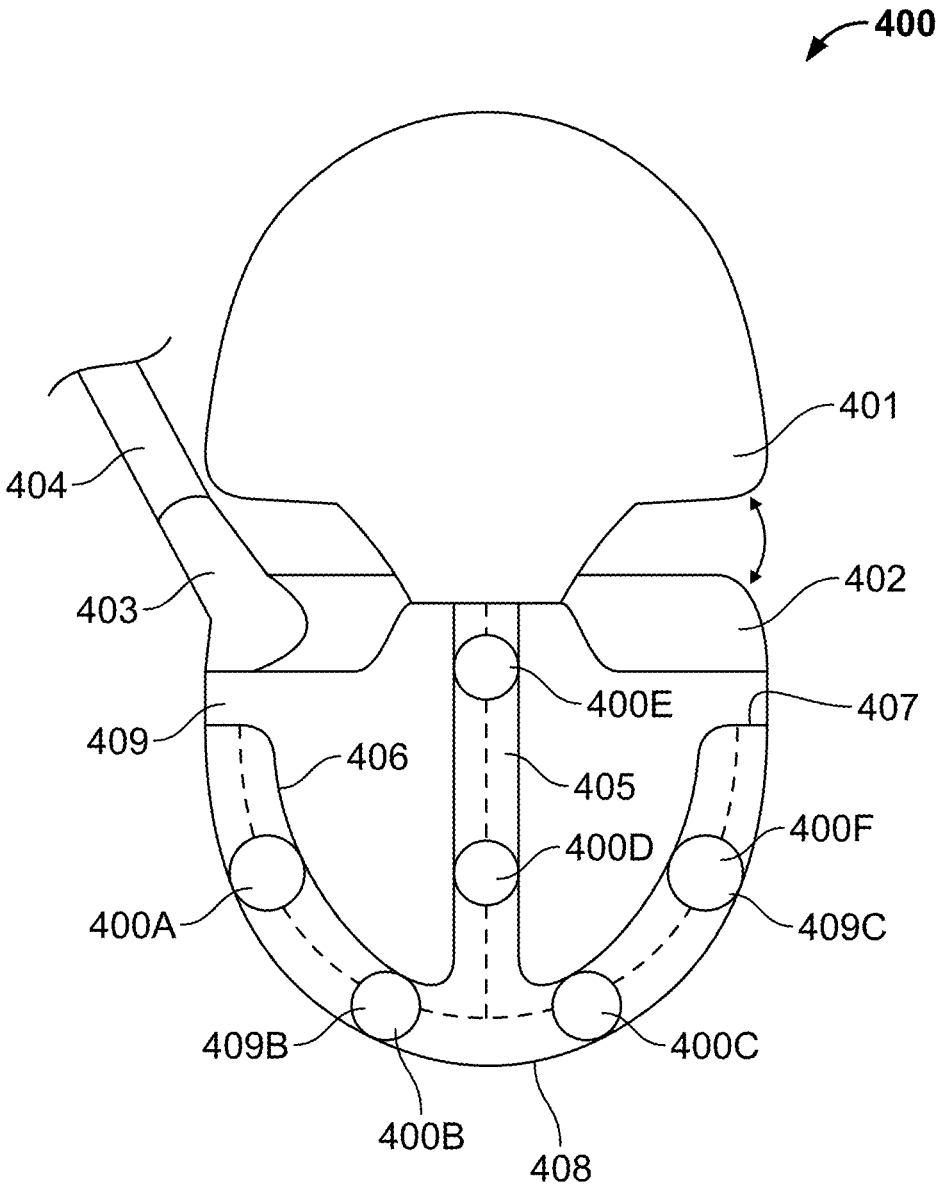
FIG. 1 is a perspective view of a first embodiment of a golf club head in an opened configuration.

Although the present invention will be described with reference to the embodiments shown in the drawings, the golf clubs described herein can be embodied in many alternate forms of embodiments, to include other sporting equipment such as a tennis rackets or baseball bat, whereby aspects of the invention may be incorporated therein. In addition, any suitable size, shape or type of elements or materials could be used within different club types such as hybrid and fairway woods club types. Similarly, with reference to FIG. 6, the technology described can be used in 'irons' and 'wedges' club types.

The category of golf club illustrated in FIG. 1 is generally referred to as a "driver", and has a lower surface (sole) and a top surface (crown), in addition to a heel, toe and shaft connected to the club head via a hosel.

As per USGA rule, the club head for a driver may have a maximum volume of 460 cc to which the invention adheres to stringently.

Referring to FIG. 1 there is shown a perspective view of a golf club having a head 400 and a shaft 404. A crown 401 is shown in the opened position, fixed by a hinge 401A to the club head at the forward section of the golf club.

A cartridge 407 with adjustable weights is situated within the cavity of the club head, anchored by a base (not shown) which may be removable by the golfer and replaced with a cartridge having fixed weights, a set of similar weights or movable weights, arranged in a 3D contour, similar to the U.S. patent issued to Carter.

The weights 400A, 400B, 400C . . . 400N may also be designed in any manner, to be movable on a 2D or 3D plain, to adjust the COG of the club head once positioned into the club's cavity from the crown.

The set of spherical weights 400A, 400B, 4000 . . . 400N are arranged in a 3D manner inside of the club head, secured within multiple interconnected tracks, 405,406 & 407 in FIG. 23.

The tracks of FIG. 1 are situated in the removable cartridge embodiment, which is then secured inside of the club head by a screw or clamp.

The burrow of the track may take the form of a 3D configuration to traverse the complex inner contour of the of the sole and perimeter of the club head.

To access the spherical weights 400A, 400B, 400C . . . 400N and manipulate them in a manner similar to that in U.S. Pat. No. 9,700,764, crown 401 serves as an access port (door), capable of swinging on hinge 401A. Crown 401 may be transparent, translucent, opaque or contain a LCD color or holographic screen.

Crown 401 may also fabricated from any number of lightweight materials such as carbon fiber, titanium or composite materials having low density and superior strength. Crown 401 may be securely affixed by hinge 401A or more than one hinge and secured by at least one screw or clamp member to the body of the club head 400, either from the front, back or sides of the club head structure.

The weights can comprise a spherical member disposed in a channel; an external member to the cartridge having a portion external to a channels therein; and a coupling between the spherical member and the external member to allow the spherical member and the external member to securely capture between them a wall within the cartridge and track from within the cavity of the head of the club.

Figure 2:
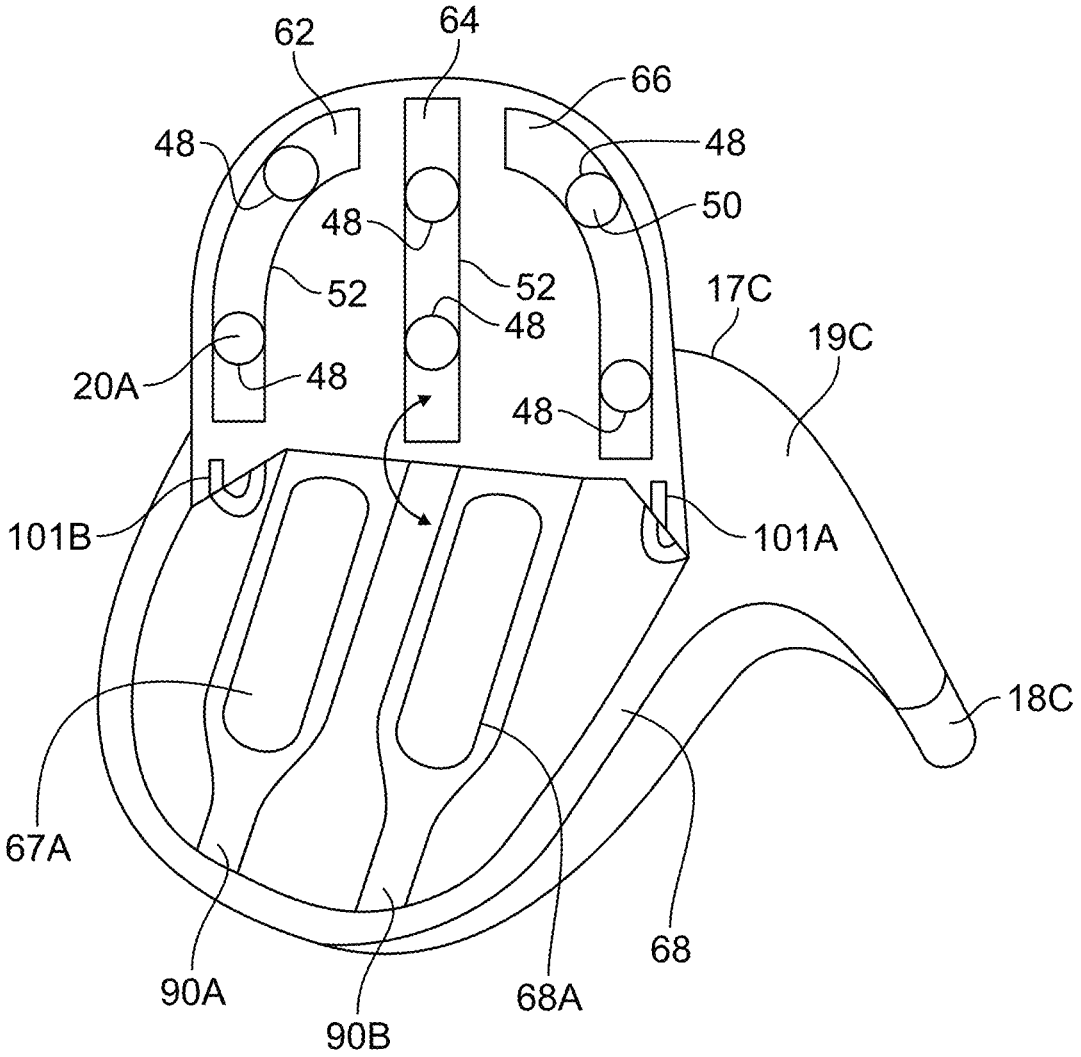
FIG. 2 is a perspective view of a second embodiment of a golf club head in an opened configuration.

With reference to FIG. 2 (page 2), the sole aspect of the club head is shown in the opened position, similar to the crown described above, to receive one or more weights/cartridges as before, to be secured onto the sole aspect of the club head, by a screw or clamp mechanism, onto a receiving base. With reference to the embodiment of FIG. 2, the access port may also have a spring member affixed to the hinge or separately, to facilitate opening at 101A and 101B.

The replaceable cartridge may be an assortment of moveable weight components, which may traverse a 2D or 3D contoured (track) or be comprised of fixed, non-moveable weight. The golfer will exercise the option to choose the weight-cartridge that may best suit his/her need.

Weights inside of the clubhead can be adjusted from within the golf club's head cavity, by opening the access port of the club head, allowing access to the tracks with weights thereupon, to then add or subtract one or more weights simultaneously or individually, or adjust the spherical weight's position onto any of the multiple interconnecting tracks.

In other embodiments, a cartridge containing a predetermined configuration of fixed or moveable weights can be placed inside of the cavity of the club's head and clamped or screwed into position, onto the sole of the club, from the inside. The cartridge can have interconnecting tracks in a variety of configurations to place the COG of the club head to the periphery, sole and to the center as desired by the user.

As before, weights can be moved from one track to another, using the interconnected system of tracks, allowing weights to move from the sole to the periphery, to the front, the back, and towards the face of the club to achieve variable playability.

Figure 4:
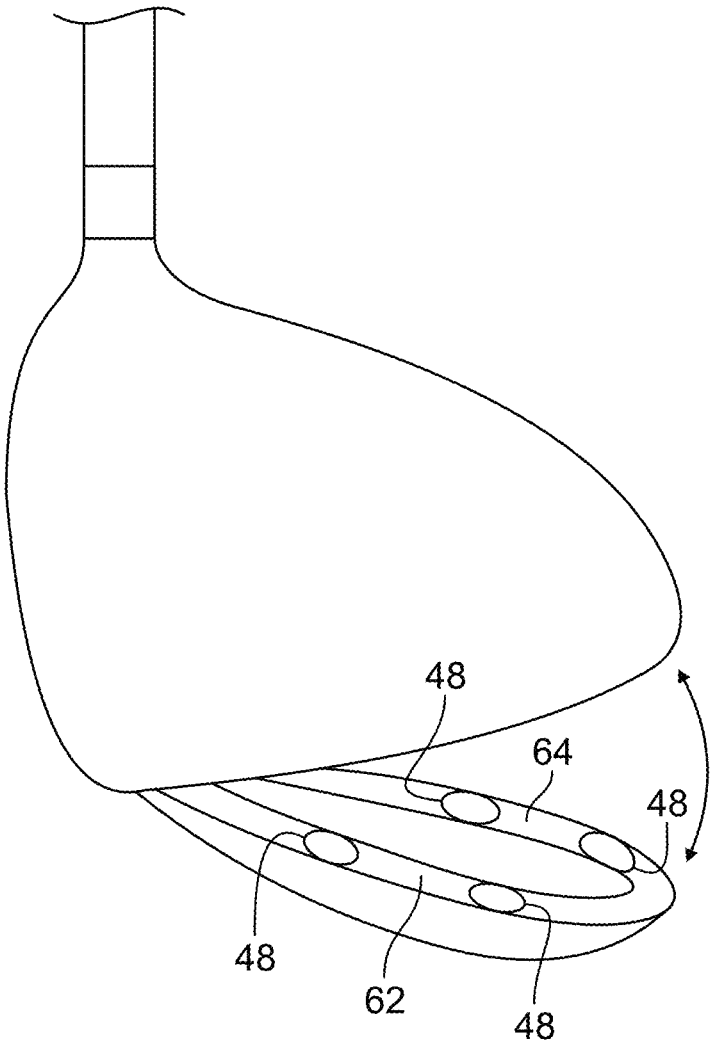
FIG. 4 is a side view of a golf club head in a partially opened configuration.

The tracks can also be included in the pivoting or articulated crown or cover, as in FIG. 2 and FIG. 4.

Figure 3:
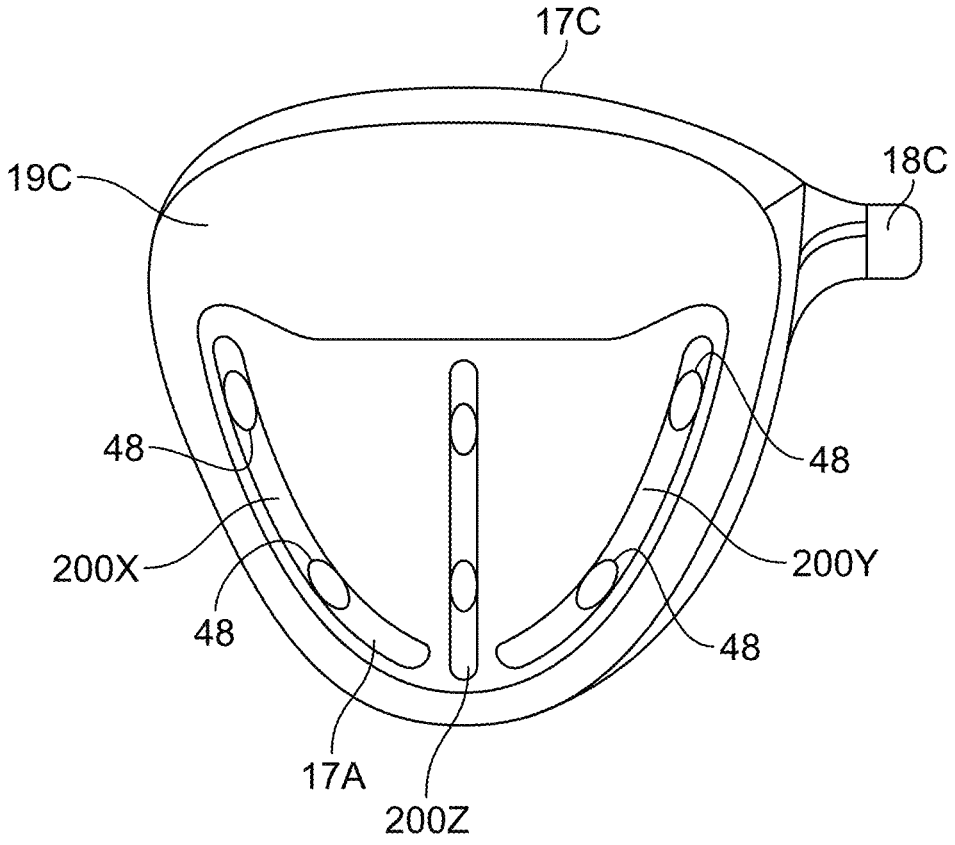
FIG. 3 is a bottom view of a golf club head.

With reference to FIG. 3, transparent or translucent viewing windows: 200X, 200Y & 200Z are incorporated to observe the precise location of weighted spheres 48, to be gauged from the outside of the club head, i.e., from the sole. The viewing windows allow for the weights to be secured within the club head, from within the cavity, while visually observing their location from the outside once the access door is in a closed position.

Once the sole of the club member is in a closed position it is protected from the elements. A single screw mechanism within the sole may secure the articulating sole member (crown or door) to the body of the club head when in a closed position, allowing the club to appear even more "plain in design," with no gutted trough or appendages associated with the screws, projecting from the club head.

In FIG. 3 the weight are secured into the cover of the club head, from the inside of the club while permitting the visualization of the weights via aperture-windows 200*x*, 200*y* and 200*z*. The aperture may also be used after a weight-cartridge is affixed to the sole of the club 'door' embodiment, when in the opened position. Once in the closed position, the weight-cartridge installed component is only visible via the aperture from the outside. The weights are secured within the tracks in a similar manner as described in Carter's patent.

In FIG. 4, the sole of the golf club in an opened position (side view). The weights 48 are illustrated to be located in a peripheral track, which may also be configured to have a center track or other tracks to interconnect (not shown in this figure).

The cover may have slits or crevices within its tracks, to allow for the spheres to be further secured thereto by a frictional means along any given point of the track. In so doing, the weights are not secured into the recesses and restricted to finite locations as seen in Chen & Chao et al.; instead they are levitated closer to the sole of the club head and secured thereto onto the articulating cover/sole/port of the club head. Similar configuration can be provided for the crown, whereby the weights are secured to the crown of the club head.

Other clubs within the golfer's array of approved (hybrids) or non-conforming clubs may be fashioned by design to incorporate the benefits of this invention.

In accordance with the embodiments described, golf club heads are provided with a scalable system of weights which allows for a precision and convenient adjustment of the COG without having to remove, switch or change weights from a golf club's head, or change the club's orientation to access the weights from within the club's head.

The embodiments described are an advanced golf club technology, which allows the movement of weights in (3D) three dimensions, that is, across a three dimensional surface, having complex slopes or curves. Moreover, the tracks or recesses, which house the movable weights, can be accessed from the hood (crown) when the articulating member is in the opened position; the weights may also be accessed and adjusted from the sole when the articulating member of the sole in the open position.

Preferably the weights are added as a collective set situated into a cartridge, having tracks therein, with an access point being the crown to affix the cartridge into the cavity of the club head onto the sole. The access point to inside of the club head may be the sole, when the port is in the open position, allowing weights to be secured to the crown; or both the crown and sole at the same time.

To traverse the complex contours of a golf club's head, the weights can have the shape of a sphere or two segments of a sphere, designed in such a way as to expand and lock into position, along any segment of the interconnecting tracks.

The weights can have a biasing knob member, which limits its ability to turn left, right, up or down to approximately 340 degrees in a 3D manner. The weights may have a screw member which cause the half spheres to push outwards and expand, creating a higher degree of friction and resistance to movement, locking a weight into a fixed position, when expanded.

The embodiments described also feature replaceable cartridges having variable COG configuration from moveable weights therein to affect the club's playability and moment of inertia. The cartridges may be constructed of a homogenous material, such as a metal or a combination of metal alloys and or synthetic materials.

Figure 5:
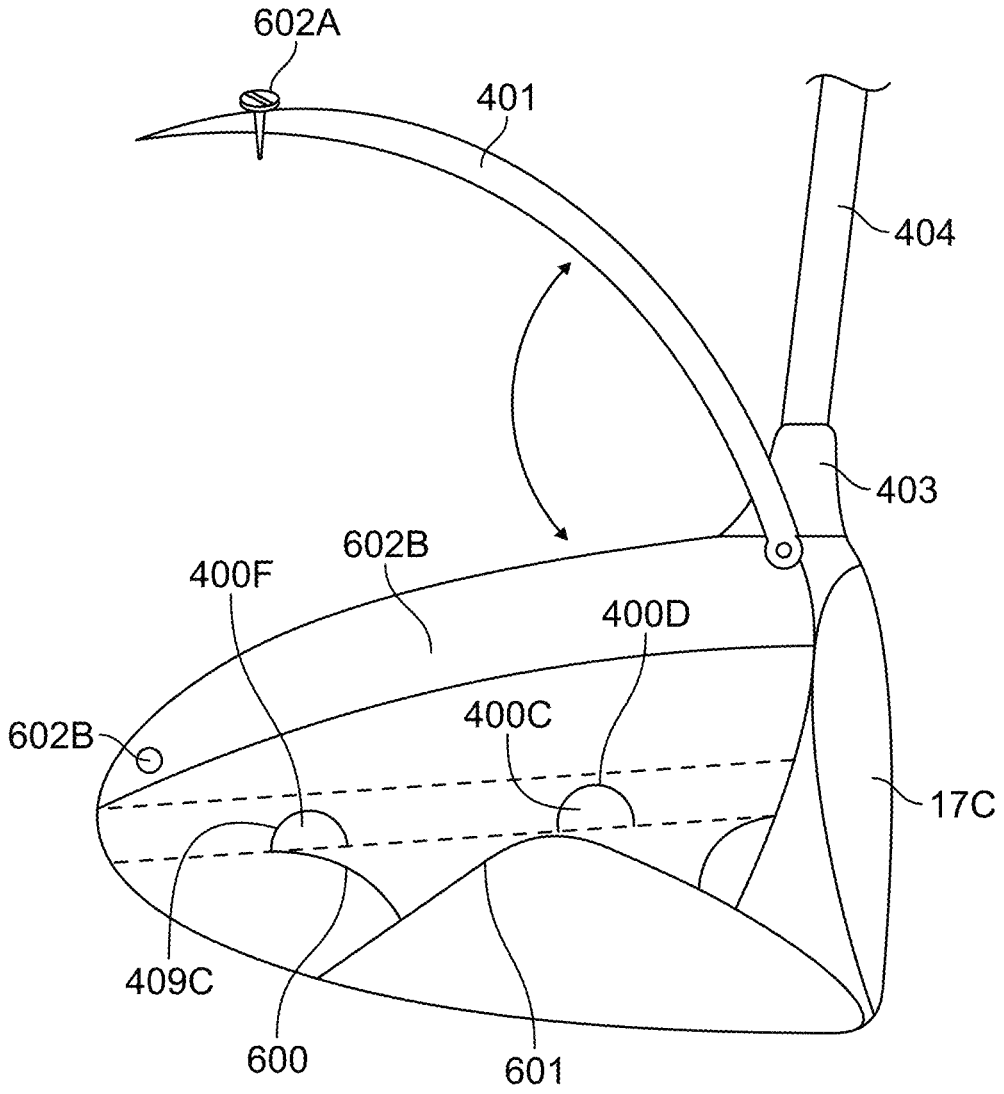
FIG. 5 is a partially cut away side view of a golf club head in an opened configuration.

FIG. 5 illustrate the club head in a side view profile, depicting a screw member 602A attached to the rear end of the crown, to lock the crown in place to a threaded opening 602B. The articulating crown member is attached to the club head by hinge at the forward crown section 17C. Moveable weights are depicted with middle section of the cavity of the club, within a visible track, thereby moving the COG along the path, between the crown and sole.

Support for the tracks may be provided with buttresses 600 and 601, anchoring the track to the sole of the club from the inside cavity.

LED Bulbs

It is a further object of the embodiments described to incorporate decorative and functional lighting, in the form of LED bulb, connected to a replaceable battery and a switch.

The switch may preferably be positioned inside of the handle of the club shaft, accessible from the top of the shaft. The switch may also be placed outside or inside of the club head, or hosel.

The LED lighting can be used to illuminate a portion or all of the logo element, associated with a club head.

The LED bulbs being lightweight and comprising of any available color add negligible weigh to the club head overall.

An LED bulb of any color in the spectrum may be turned on or off, to illuminate the location of each weight or illuminate around the weights when the weights are made of opaque material.

The LED bulb within the club head can be controlled to an on and off position to adjust the brightness, from the handle of the club embodiment. However the switch may be positioned at any position (point) along the length of the shaft or behind the club face.

The battery to power the LED bulbs may be situated into the handle of the club shaft for easy access to install or replace; or inside of the club head. The LED bulbs may also be incorporated in the club head for decorative purpose other than to illuminate the logo.

Figure 6:
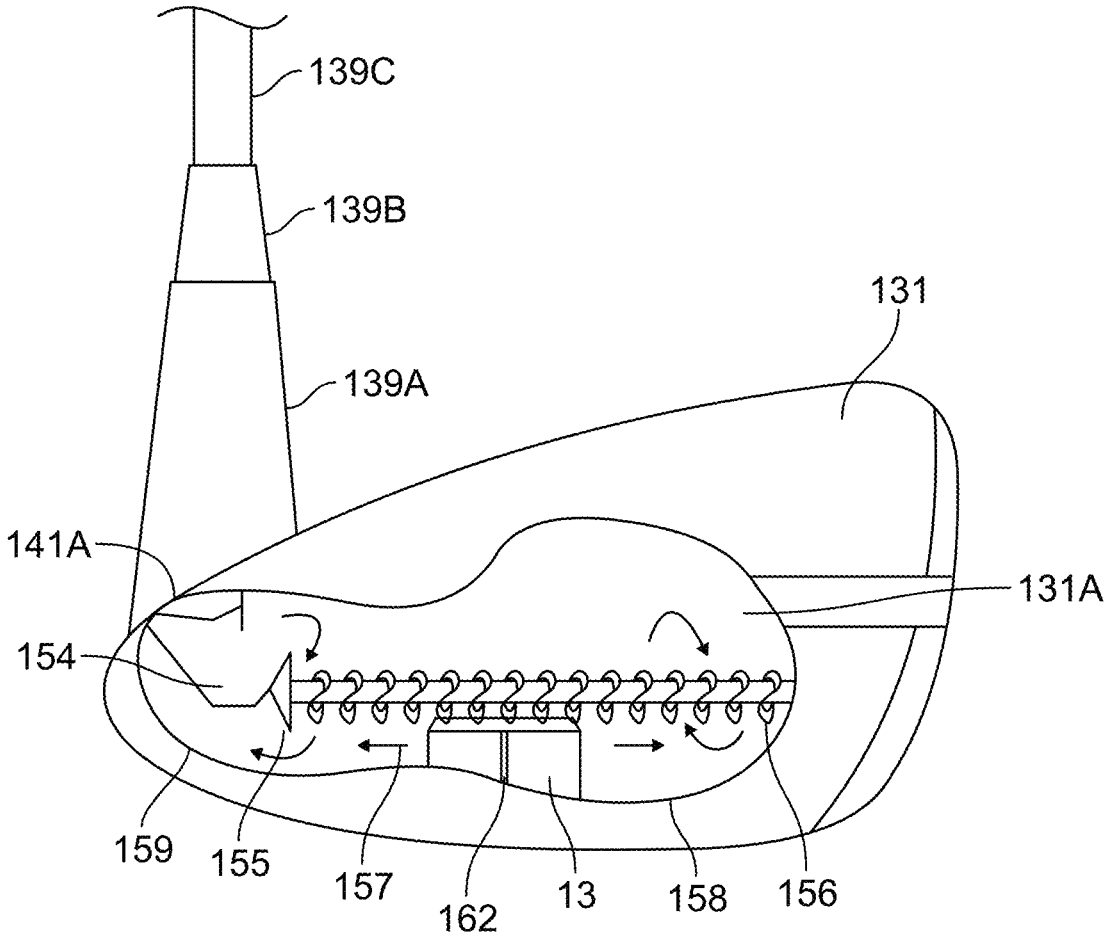
FIG. 6 is a partially cut away side view of another golf club head; specifically an iron.

FIG. 6 depictions an "iron' or "wedge" club wherein the posterior aspect is shown having an adjustable weight 13, movable along a surface or surface or plane 157-158, on a track. The weight therein may be removable and replaced with a static (non-moveable) weight member or a moveable weight member having a different density that may be heavier or lighter than the replaced weight component.

The entire apparatus comprising of a cogwheel 155 and 156 engaging with the grooves of the weight 162 & 13, may be replaceable as a complete component or replaceable block.

Figure 7A:
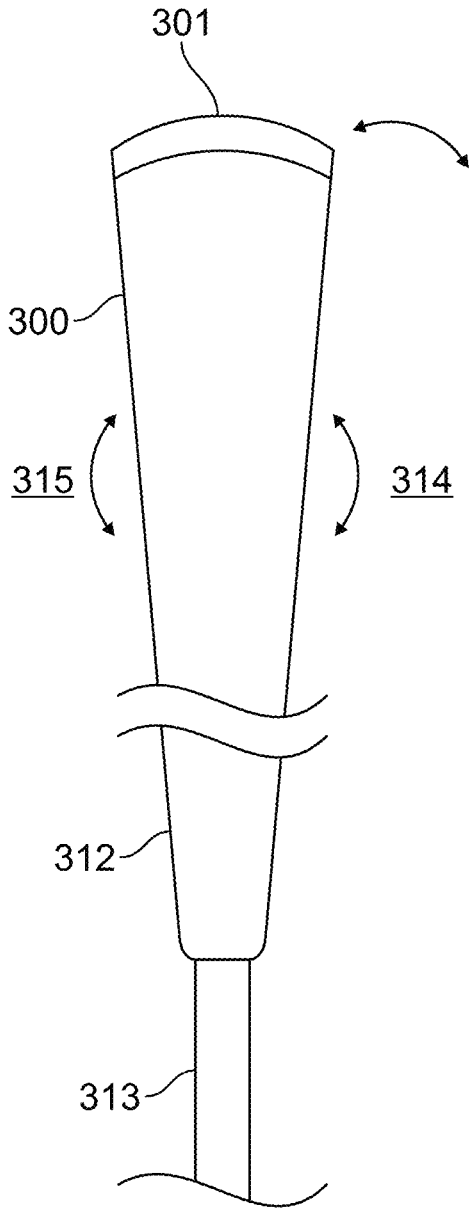
FIG. 7A is a side view of a golf club handle.
Figure 7B:
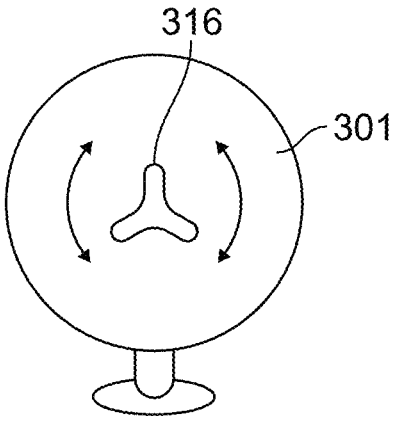
FIGS. 7B and 7C are views of a rachet mechanism within the handle of FIG. 7A.
Figure 7C:
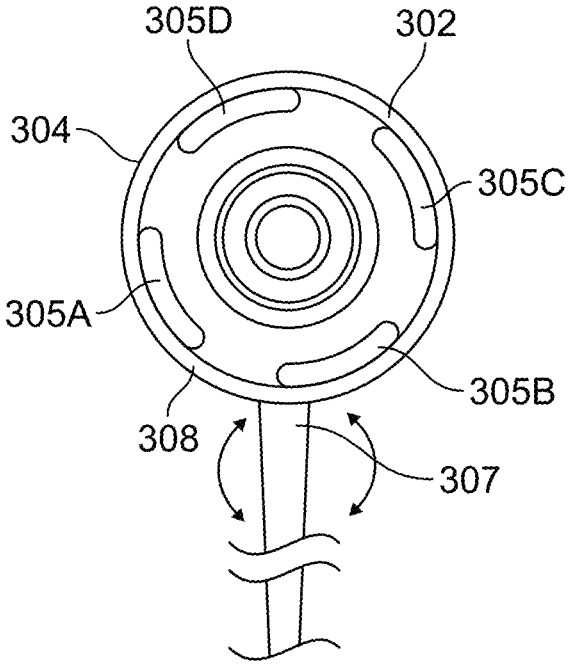

As shown in FIGS. 7A, 7B and 7C, the movable weight 13 is adjustable from the club handle, preferably by a ratcheted mechanism as depicted in FIG. 10, with biasing gear and lock mechanism 305B and 305 C.

Biosensors

In another embodiment, the club head of preferably a driver is equipped with a LCD screen on the crown and sensors attached thereto from the inner or rear portion of the face of the club head. A circuit board, battery and software are all built inside of the club head to determine the trajectory and distance of a golf ball, following impact. The strike location on the club face can also be determined and displayed visually on the LCD screen after impact. The technology is intended to give the user immediate feedback during training exercise.

Further the golf club handle is equipped with one or more biosensors to detect a pulse rate and or electrocardiogram activity to determine the player's level of focus and concentration while addressing a golf ball. The data is processed using proprietary software to give the golfer feedback on his or her state of readiness and calmness when addressing a golf ball. The data and or instructions may be graphically displayed on the LCD or similar screen type situated on the crown, visible when the golfer is addressing the golf ball.

In other embodiments, the LCD screen may be located inside of the club head and accessible when the port or (crown) is in the opened position.

What is claimed is:

1. A golf club comprising:

a head having a crown and a sole;

an articulating cover, located on the crown and sole of the head to define an opening when the cover is in a opened position, and when in the opened position receiving a cartridge containing a moveable set of weights, the weights being positioned within one or more tracks that are interconnected in a 2D or 3D configuration;

a spring member facilitating moving the cover to the opened position; and a hinge on which the cover is coupled to the head, the spring member acting on the hinge.

2. The golf club of claim 1, wherein said tracks all interconnect with one another to allow a weight to be moved from one track to another track and thus from one channel to another channel within the cartridge, when the cover is in the opened position.

3. The golf club of claim 1, wherein said tracks are within said cartridge, and said weights are secured within said cartridge.

4. The golf club of claim 1, wherein the cartridge is formed of a material selected from the group of transparent, translucent and opaque material.

5. The golf club of claim 1, wherein said tracks extend to a rear portion of said cartridge when secured to the sole of the head.

6. The golf club of claim 1, configured in the form of a wood or driver.

7. The golf club of claim 1, wherein the weights are comprised of materials selected from the group consisting of a metal, lead, tungsten, and iron.

8. The golf club of claim 1, further comprising a powered LED light bulb for illumination of a logo or its internal structure.

9. The golf club of claim 8, further comprising an LCD screen situation on the crown or inside cavity of the club head, to view the trajectory and distance of a launched golf ball along with swing characteristics of the golfer.

10. The golf club of claim 1, further comprising sensors on the handle to detect the heart rate and rhythm of the user, to give a user feedback to determine degree of focus when addressing a golf ball.

11. The golf club of claim 1, further comprising a mechanism for securing the cover in a closed position.

12. The golf club of claim 11, wherein the mechanism is one of a screw and a clamp.

13. The golf club of claim 1, further comprising a mechanism for securing the cover in a closed position.

14. The golf club of claim 13, wherein the mechanism is one of a screw and a clamp.

15. A golf club comprising:

a head having a crown and a sole;

an articulating cover, located on the crown and sole of the head to define an opening when the cover is in a opened position, and when in the opened position receiving a cartridge containing a moveable set of weights, the weights being positioned within one or more tracks that are interconnected in a 2D or 3D configuration;

a spring member facilitating moving the cover to the opened position; wherein said weights comprise:

a spherical member disposed in one of said tracks, within said cartridge, a fastening member having a portion external to a surface of said cartridge or track; and a coupling between said spherical member and said external portion, to, allow said spherical member and said external portion to securely capture between them a wall of said cartridge in which said track is formed.

16. A golf club comprising:

a head having a crown and a sole;

an articulating cover, located on the crown and sole of the head to define an opening when the cover is in a opened position, and when in the opened position receiving a cartridge containing a moveable set of weights, the weights being positioned within one or more tracks that are interconnected in a 2D or 3D configuration;

a spring member facilitating moving the cover to the opened position; and markings on the sole, which show ideal position or orientation for each individual weight for at least one of low or high moment of inertia; high and low trajectory, and fade or draw via a transparent or translucent apertures or windows.

* * * * *